United States Patent [19]

Norman et al.

[11] 4,043,763

[45] Aug. 23, 1977

[54] STABILIZATION OF DRIED COAL

[75] Inventors: Oscar L. Norman, Wilmington, Del.; Walter H. Seitzer, West Chester, Pa.

[73] Assignee: Suntech, Inc., Wayne, Pa.

[21] Appl. No.: 758,890

[22] Filed: Jan. 7, 1977

Related U.S. Application Data

[63] Continuation-in-part of Ser. No. 676,026, April 12, 1976, abandoned.

[51] Int. Cl.[2] ..... C10L 5/00

[52] U.S. Cl. ..... 44/1 R; 44/1 G

[58] Field of Search ..... 44/1 R, 1 G; 201/24

[56] References Cited

U.S. PATENT DOCUMENTS

| | | | |
|---|---|---|---|
| 914,523 | 3/1909 | Shepard | 44/1 R |
| 1,557,320 | 10/1925 | O'Donnell | 201/24 X |
| 2,328,147 | 8/1943 | Hyson | 44/1 R |
| 3,723,079 | 3/1973 | Seitzer | 44/1 R |

*Primary Examiner*—Carl F. Dees

*Attorney, Agent, or Firm*—J. Edward Hess; Donald R. Johnson; Paul Lipsitz

[57] ABSTRACT

A process for stabilizing lignitic and sub-bituminous coal against spontaneous combustion which comprises mixing as-mined lignitic or sub-bituminous coal with said hot, completely or partially dried lignitic or sub-bituminous coal in an amount to produce a weight ratio of dried coal to as-mined coal of from about 1:2 to about 10:1.

7 Claims, No Drawings

STABILIZATION OF DRIED COAL

CROSS REFERENCES

This application is a continuation-in-part of Ser. No. 676,026, filed Apr. 12, 1976 now abandoned.

Lignitic and sub-bituminous coals are received from the mine containing from about 25 to about 40% by weight internal moisture and such coals are usually subjected to a drying procedure before use. Numerous types of equipment and techniques for such drying are available and have been used for some time. In general, a hot combustion gas is used to drive moisture from the coals and this is done either by passing such gases through a bed of the coal, often a fluidized bed, or by passing the coal through a kiln or other rotary device while the hot gases are passed through. A particularly useful commercial device for such coal drying is the Parry Dryer (see U.S. Pat. No. 2,666,296) which employs the hot combustion drying gases to fluidize the coal. In commercial use the combustion gases are usually obtained from coal or fuel oil and the fuel-air ratio is maintained so that the combustion gases contain about 5 percent by volume oxygen. The dried coal emerging from the dryer generally contains from 0.5 to about 10% by weight of water, and might even be somewhat higher.

Dried lignitic and sub-bituminous coals are unstable to storage in that they are subject to air oxidation and combust spontaneously. Thus, in order to enhance storage stability special treatments must often be used. For example, coal piles are often arranged in a particular manner to obtain safe storage; e.g. thin layers which are compacted with sloping sides at a maximum angle of 14°, smooth final surfaces, and top surface continually smoothed as coal is removed from the top only. Other approaches to prevent spontaneous combustion during storage involves chemical treatment of the coal; e.g. coating the coal with petroleum products and their emulsions, spraying with calcium bicarbonate or aqueous hydroquinone or amines. Such treatments, however, are either not completely effective or are excessively expensive for a low priced commodity such as coal.

In U.S. Pat. No. 2,844,886 a process for handling wet carbonaceous materials such as coal in a fluid system to effect carbonization is disclosed wherein a dry preheated coal at relatively low temperature is intimately mixed with a higher temperature pretreated coal. Prior to the mixing step, the preheated coal at the relatively low temperature is partially burned by contact with oxygen to "case harden" the particles and reduce their agglomeration tendencies. Such a procedure is useful for the carbonization process since it reduces the volume of hot gases that would be needed and improves the economics. There is no concern or need in such process, however, for a stabilized coal as it is not subject to storage and/or shipment and, in fact, the complete drying of the coal enhances, rather than reduces, spontaneous combustion.

In U.S. Pat. No. 2,328,147 an improved fuel from coal is obtained by blending about 80% of run of mine bituminous coal with 20% of anthracite (a No. 4 buckwheat coal), such composite containing from about 4 to 6.4% water. Among the benefits stated for such a fuel is that due to its lower volatility as compared to bituminous coal alone, the danger of spontaneous combustion in storage is reduced. It is to be noted that the anthracite coal employed in the above process contains about 8 to 12% moisture and the bituminous run of the mine coal contains 3 to 4% moisture and such coals are not generally subjected to a drying step prior to storage and shipping. Thus, it is obvious that these coals are significantly different from sub-bituminous and lignitic coals which, as pointed out above, contain from about 25 to about 40% by weight of moisture.

We have now found a means to significantly improve the storage stability of lignitic and sub-bituminous coal and this is accomplished, in accord with our invention, by the process which comprises mixing said coal dried to a moisture content of from about 0 to about 10% by weight with undried, as-mined coal so that the weight ratio of dried coal to asmined coal in the stabilized product is from about 1:2 to about 10:1.

The coals used in the process of the invention will be, as indicated, lignitic and sub-bituminous coals and will include North Dakota lignite, Powder River sub-bituminous coal, Wyodak coal, and the like. Such coals usually contain from about 25 to 40 percent water as they come from the mine, and are normally dried to a water level of from about 0.5 percent to about 10 percent by weight and this is readily done simply by flowing hot flue gases, generally at a temperature of from about 80° to about 250° C., through the coal as described above. The process of the invention is applicable to coal of any size, but will, of course, be of most value with the smaller sizes since they have the greater surface area and are most subject to oxidation.

In carrying out the process of the invention, the hot dried coal, preferably of from about 0.5 to about 10% moisture (most preferably about 5%) and the proper amount of coal as taken from the mine are simply blended together, preferably in a continuous manner to produce the cooled, stabilized coal product. Any of the various commercial blending apparatus may be used such as a rotating drum, screw conveyer, belt conveyer, or the coal may be mixed by simultaneous introduction into a storage silo. The temperature of the dried coal as it is mixed with the as-mined coal will be from about 80° to about 300° C, preferably, about 100° to about 200° C.

The mixed coal product will be comprised of a weight ratio of the hot, dried coal to as-mined coal of from about 1:2 to about 10:1 depending upon the initial temperature of the hot dried coal and the degree to which rehydration is desired. The following table illustrates how a particular ratio may be selected, it being understood that these ratios may have to be adjusted for a specific coal depending on its particular characteristics. The function of a particular ratio is to add enough as-mined coal to give a stable mixture and at the same time, hold the moisture content of the mixture to a minimum in order to minimize the cost of transporting the coal to market.

TABLE

RATIO REQUIREMENTS OF AN AS-MINED SUB-BITUMINOUS COAL CONTAINING 30% MOISTURE TO HOT, DRIED COAL

| | Requirements |
|---|---|
| A Requirements For Cooling | Parts by Weight of As-Mined Coal per 100 parts of Hot Coal |
| To cool coal heated at 100° C | 16 |
| To cool coal heated at 200° C | 38 |
| B Requirements for Rehydration | |
| To Rehydrate coal containing 0% Moisture | 58 |
| To Rehydrate coal containing 5% Moisture | 32 |

TABLE-continued

RATIO REQUIREMENTS OF AN AS-MINED SUB-BITUMINOUS COAL CONTAINING 30% MOISTURE TO HOT, DRIED COAL

| A Requirements For Cooling | Requirements: Parts by Weight of As-Mined Coal per 100 parts of Hot Coal |
|---|---|
| To Rehydrate coal containing 10% Moisture | 5 |

Therefore, in view of the data in the above table, the required ratio for a particular coal can be easily calculated. For example, if it is desired to stabilize a coal having a 10% moisture level, at 100° C., it is necessary to use 16 parts plus 5 parts of as-mined coal per 100 parts of hot coal; i.e., a ratio of hot, dried coal to as-mined coal of 100:21 or 5:1. Similarly, to stabilize a coal completely dried at 200° C, 38 parts plus 58 parts of as-mined coal per 100 parts of hot, dried coal would be used; i.e., 100:96 or 1:1. It is understood, of course, that the correct ratio for any particular coal depends on the degree of rehydration and the final temperature.

The mechanism of the stabilization as achieved by this process is not completely understood, but it appears that the addition of the as-mined coal to the hot, dried coal effects:

a. cooling of the hot coal by heat transfer and by evaporation of some water from the as-mined coal, and b. transfer of moisture from the as-mined coal to the dried coal which thereby releases and dissipates the heat of hydration.

In order to further illustrate the invention the following examples are given:

EXAMPLE 1

A sample of sub-bituminous coal was dried to 0% moisture in a vacuum oven at 110° C. This coal was tested for stability by placing it in a Dewar flask at 62° C and passing wet oxygen up through the coal bed at a rate of 200 ml. per minute. After 5 hours and 6 minutes, combustion of the coal occurred.

EXAMPLE 2

A sample of dried coal as in Example 1 was mixed in equal weight quantities with untreated coal and tested. This 50-50 mixture was quite stable in that the temperature of the bed rose only to 71° C and then fell off again without combustion occuring after 67 hours.

EXAMPLE 3

Dried coal as in Example 1 was mixed with as-mined coal in a ratio of 4.9:1. This coal was also stable in that the bed temperature increased to 89.5° C in 17 hours and then dropped rapidly (to 79° C in 7 hours) without combustion.

EXAMPLE 4

A sample of fresh Wyodak coal was dried to contain 4.5% moisture. In the stability test described above this coal combusted after 6.2 hours.

A sample of this dried coal was mixed with fresh as-mined coal in a ratio of 2:1 and the mixture tested. The temperature peaked at 81° C after 53 hours and then decreased; no combustion occurred.

EXAMPLE 5

A sample of fresh Wyodak coal was dried completely and tested as in Example 1. This coal combusted after only 1.6 hours. Rehydrating this coal to 11% moisture by adding water stabilized it only to the extent that combustion time was extended to 7.1 hours.

However, mixing the dried coal with fresh as-mined coal in a ratio of 1.7:1 to obtain a coal mixture containing 11% moisture gave a product which was completely stable to the test, reaching a maximum temperature after 28 hours and then decreasing.

The invention claimed is:

1. A process for stabilizing lignite and sub-bituminous coal against spontaneous combustion which comprises drying said coal to a moisture level of from 0 to about 10% by weight and mixing said dried coal at a temperature of from about 80° to about 300° C with as-mined coal in a weight ratio of dried coal to as-mined coal of from about 1:2 to about 10:1.

2. The process of claim 1 wherein the coal is a sub-bituminous coal.

3. The process of claim 1 wherein the coal is lignite.

4. The process of claim 1 wherein the ratio is about 1:1.

5. The process of claim 1 wherein the ratio is about 5:1.

6. The process of claim 1 where the coal is dried to a moisture level of from about 0.5 to about 10%.

7. The process of claim 1 where the coal is dried to a moisture level of about 5%.

* * * * *